United States Patent [19]

Swanson

[11] 4,120,402

[45] Oct. 17, 1978

[54] COLOR SORTER INCLUDING A FOREIGN OBJECT REJECT SYSTEM

[75] Inventor: Ronald E. Swanson, Sunnyvale, Calif.

[73] Assignee: Acurex Corporation, Mountain View, Calif.

[21] Appl. No.: 803,125

[22] Filed: Jun. 3, 1977

[51] Int. Cl.[2] ..... B07C 5/342

[52] U.S. Cl. ..... 209/75; 209/580; 209/587; 250/226; 250/339; 356/178

[58] Field of Search ..... 209/73, 74 R, 111.5, 209/111.6, 111.7 R, 75; 250/226, 339, 578; 356/51, 178, 186

[56] References Cited

U.S. PATENT DOCUMENTS

| | | | |
|---|---|---|---|
| 3,435,950 | 4/1969 | Suverkrop | 209/75 X |
| 3,781,554 | 12/1973 | Krivoshiev et al. | 209/111.6 X |
| 3,821,550 | 6/1974 | Priest | 250/226 |
| 3,980,181 | 9/1976 | Hoover et al. | 209/111.6 |
| 3,981,590 | 9/1976 | Perkins | 209/111.6 X |

*Primary Examiner*—Joseph J. Rolla

[57] ABSTRACT

A produce sorter is described for removing culls, for example green tomatoes from red tomatoes and for removing foreign objects such as dirt and debris. An image of the produce and the foreign objects passing a station is formed on a light diffusing plate. Light from the diffusing plate impinges upon two pair of photo-transducers. The transducers are each preceded by a color filter. The color filters are selected so that one pair of transducers produces electrical signals corresponding to two colors or wavelengths and the other pair produce electrical signals corresponding to two different wavelengths. The filters for one pair of transducers are selected to pass red and green. When the red/green signals have a predetermined relationship a reject signal is generated to reject culls. Additionally, when the signals from the other pair of transducers have a predetermined relationship a reject signal is generated to reject foreign objects.

7 Claims, 6 Drawing Figures

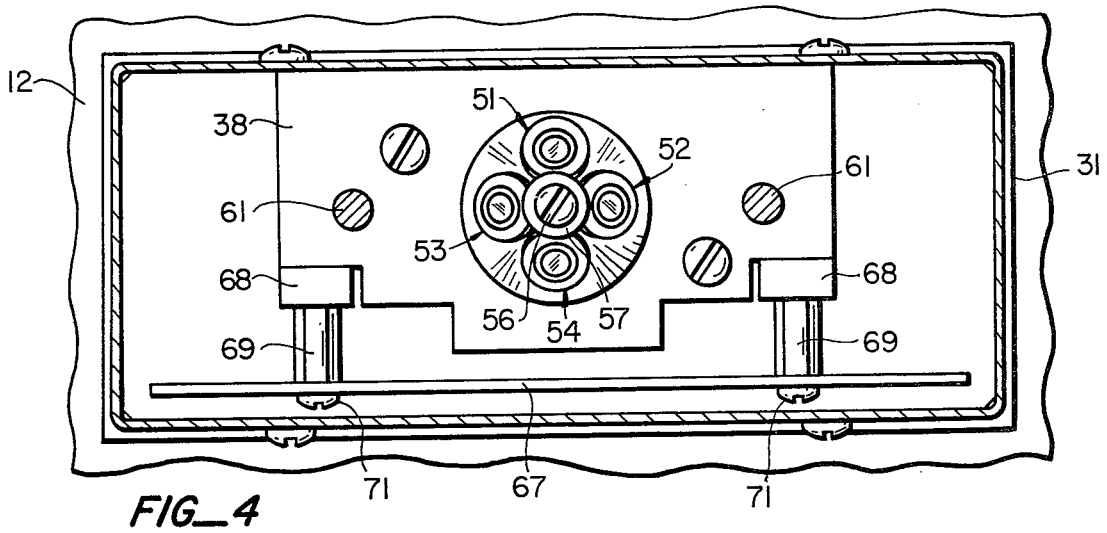
FIG_4
FIG_5
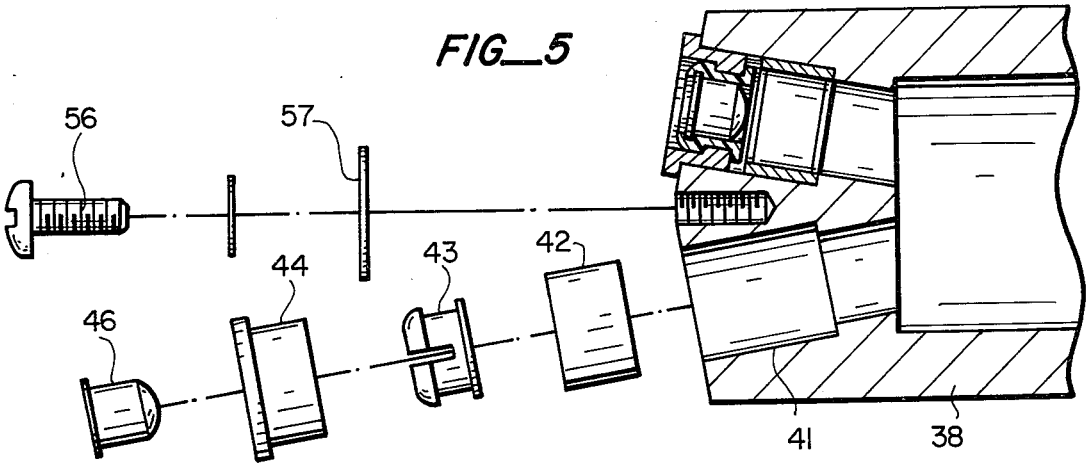
FIG_6
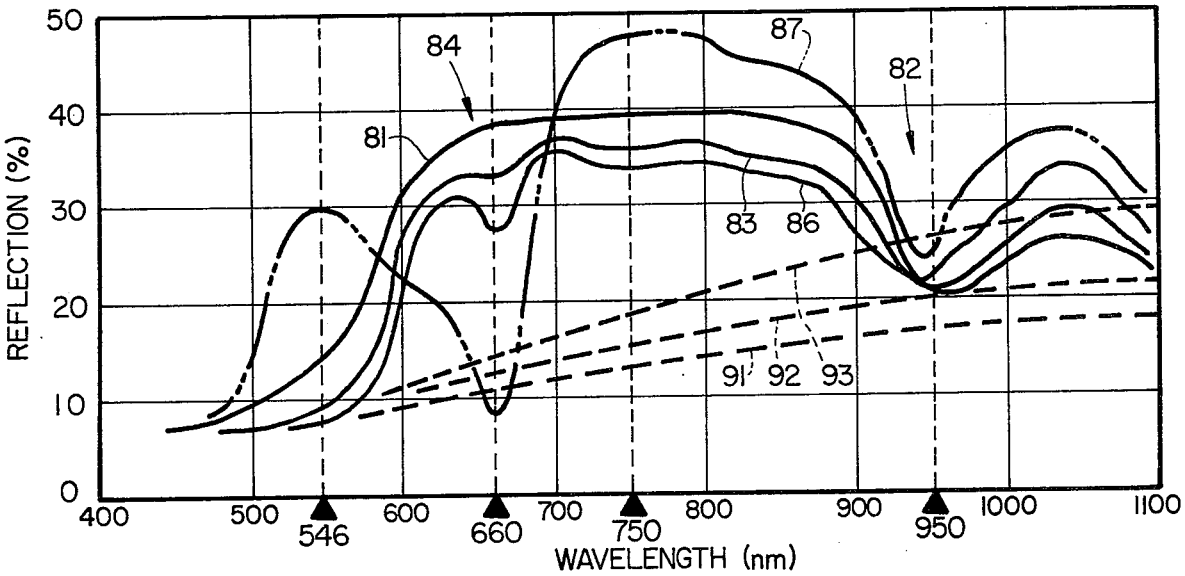

COLOR SORTER INCLUDING A FOREIGN OBJECT REJECT SYSTEM

BACKGROUND OF THE INVENTION

This invention relates generally to a sorting system and more particularly to a color sorting system for sorting produce including means for rejecting foreign objects.

An example of the usefulness of the present invention is in the handling and processing of the tomatoes. Such processing and handling in the field requires that millions of tomatoes be individually inspected and that culls, spoiled and green tomatoes, and foreign objects, such as dirt and the like, be removed. To perform this task manually is laborious and expensive.

To overcome this problem automatic tomato sorters have recently become available. Normally such sorters are constructed so that they can be used in conjunction with automatic tomato harvesting equipment such as, for example equipment of the type disclosed in U.S. Pat. Nos. 3,193,020 and 3,390,768. Tomato harvesters of this type are driven through the tomato fields removing tomatoes from the vines and depositing them on one or more tomatoe collection belts. The belts transport the tomatoes to a loading conveyor which discharges the tomatoes into trucks or the like along side of the harvester. The sorting equipment is positioned so that it views the tomatoes and objects as they are transported or conveyed to the trucks. The tomatoes on a conveyor belt are arranged in a multiplicity of parallel rows and individually viewed by the sorting equipment. If a tomato is determined to be a cull, for example, unexceptably green, a reject mechanism is energized which removes the tomato from the flow. Normally the tomato discharges onto the ground. The remaining tomatoes continue their normal course towards the discharge point. Such apparatus operates on the basis of color signals obtained by generating color signals at two wavelengths. In one type of such equipment the signals at the two wavelengths are compared and when one has a predetermined relationship to the other the tomatoes are rejected. However, such reject systems have not rejected foreign objects such as dirt and debris, from the stream. It is therefore desirable to provide equipment which is capable of rejecting foreign objects such as dirt, stems, and debris.

SUMMARY AND OBJECTS OF THE INVENTION

It is a general object of the invention to provide color sorting equipment which is also capable of rejecting foreign objects.

It is another object of the present invention to provide a sorting system in which the color characteristics of dirt, debris, stems, or other foreign objects are employed to sense and reject such objects while permitting the produce to be color sorted.

It is a further object of the present invention to provide a color sorting system in which the color of the produce is sensed and employed to reject culls or unwanted produce and which additionally includes means for sensing the color characteristics of dirt, debris and foreign objects and to reject the same as well as the culls.

It is a further object of the present invention to provide a sorting system which includes an inspection station which senses light reflected from the produce and the foreign objects. The light impinges upon two pair of phototransducers each provided with color filters selected to transmit light at different wavelengths. The phototransducers form two sets of signals each set being processed to form a reject signal when the signals in each set have a predetermined relationship. The reject signal controls a reject mechanism to remove the culls and foreign objects which flow past the inspection station.

The color sorting apparatus comprises means for moving the objects to be sorted past an inspection station along a predetermined path, means at the inspection station for illuminating the objects, a diffuser plate, means form an image of the produce on the diffuser plate to generate diffuse light, a field stop defines a light aperture disposed between the image forming means and the diffuser plates to limit the size of the image formed on the plate so that the images of produce of different sizes substantially cover the aperture, a plurality of phototransducers are disposed to receive light diffused from said plate, first and second filter means pass a relatively narrow band of green and red light to a first pair of phototransducers to form a first pair of color signals, third and fourth filter means pass narrow bands of light of different wavelengths to a second set of transducers to form a second pair of signals, first and second comparator means for receiving said first and second pair of signals and form reject signals when the signals form each pair of said transducers have a predetermined relationship indicating the presence of a cull or foreign object and means responsive to a reject signal for rejecting the corresponding cull or foreign objects from the flow.

BRIEF DESCRIPTION OF THE DRAWINGS

FIG. 4 is a sectional view taken along the lines 4—4 of FIG. 3.

FIG. 5 is an exploded view of the phototransducer assembly.

FIG. 6 is a chart showing reflection as a function of wavelength useful in understanding the present invention.

DESCRIPTION OF THE PREFERRED EMBODIMENT

Figure 1:
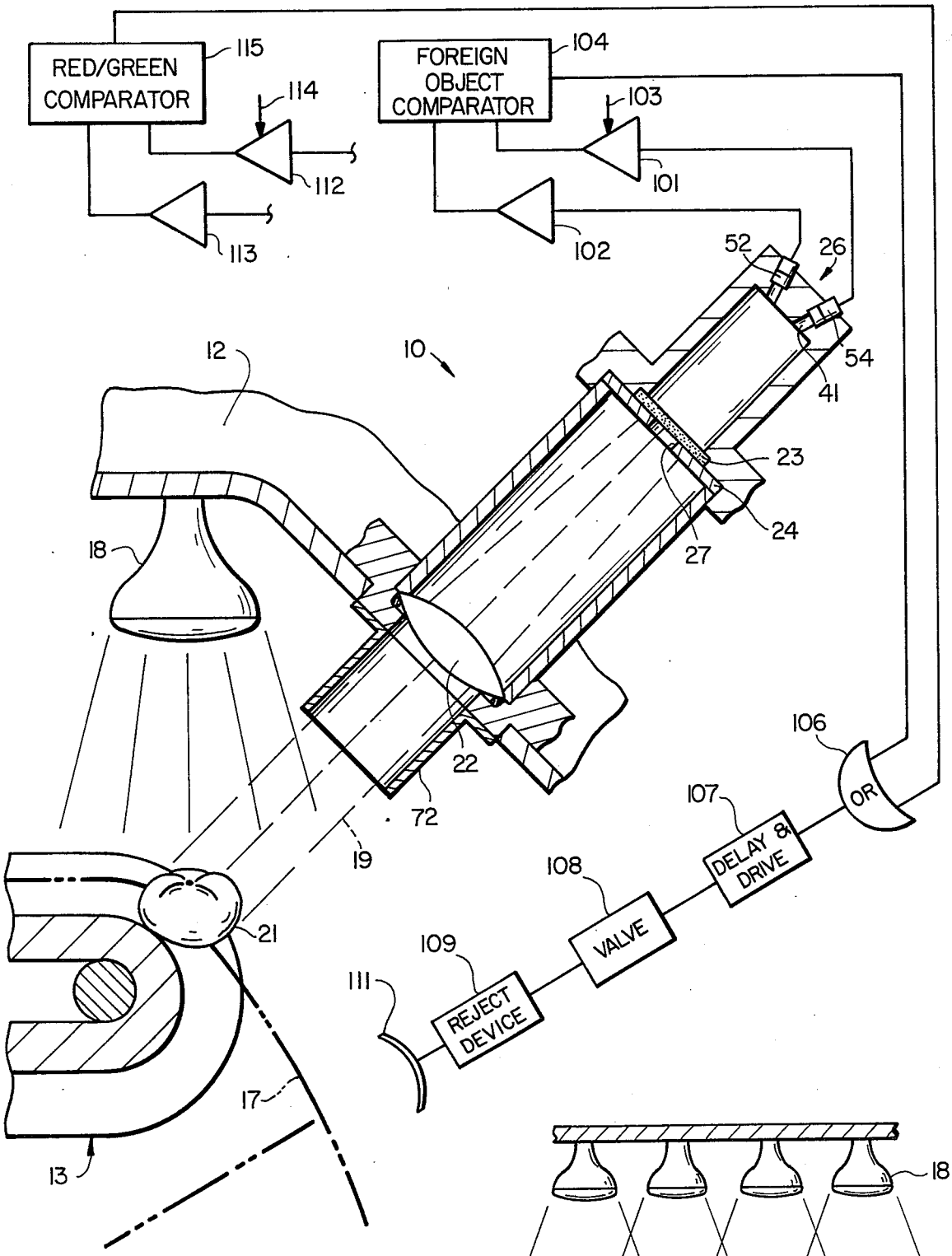
FIG. 1 is a schematic side elevational view of a sorting station in accordance with the invention.
Figure 2:
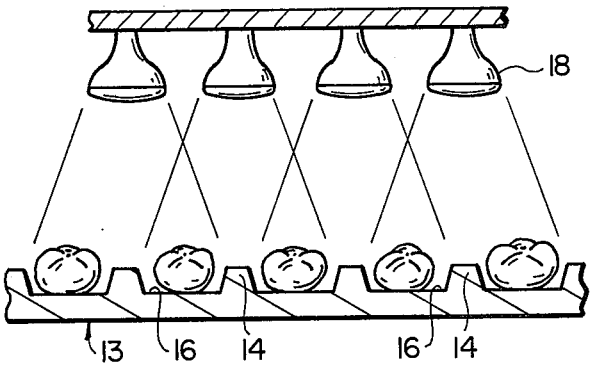
FIG. 2 is a schematic front elevational view of a typical station of the type shown in FIG. 1.

The description to follow is referenced to a tomato sorting system. It will be apparent that the system is useful in sorting other types of produce which can be sorted on the basis of reflection from the surface. Referring to the drawings, a tomato sorter generally designated by the reference number 10 is mounted on mounting means 12 attached to associated equipment such as a harvester adjacent the transport or conveyor belt 13. In practice, a plurality of sorting heads are provided in side by side relationship widthwise of the belt 13 such as shown in FIG. 2. Preferably the belt 13 includes a plurality of ridges 14 which define troughs 16 which cause the tomatoes to travel in line past individual sorters. The produce falls from the belt 13 is a trajectory such as shown in 17, FIG. 1 where it is viewed by the sorter. The tomatoes are illuminated by means of suitable lamps 18 whereby light indicated by rays 19 is reflected from the tomatoes into the optical system to be presently described.

The sorter optical system includes a lens 22 which serves to receive the light reflected from the object and to cause the same to be focused onto a diffuser plate 23 through a field stop 24. The diffuse light from the diffuser plate 23 impinges upon a plurality of phototransducer assemblies 26. Two assemblies are shown in FIG. 1. The field stop limits the field of view so that even small tomatoes form an image at least as large as the aperture. This permits the sorting of the tomatoes of various sizes with the minimum size which can be sorted determined by the size of the aperture 27 of the field stop.

Figure 3:
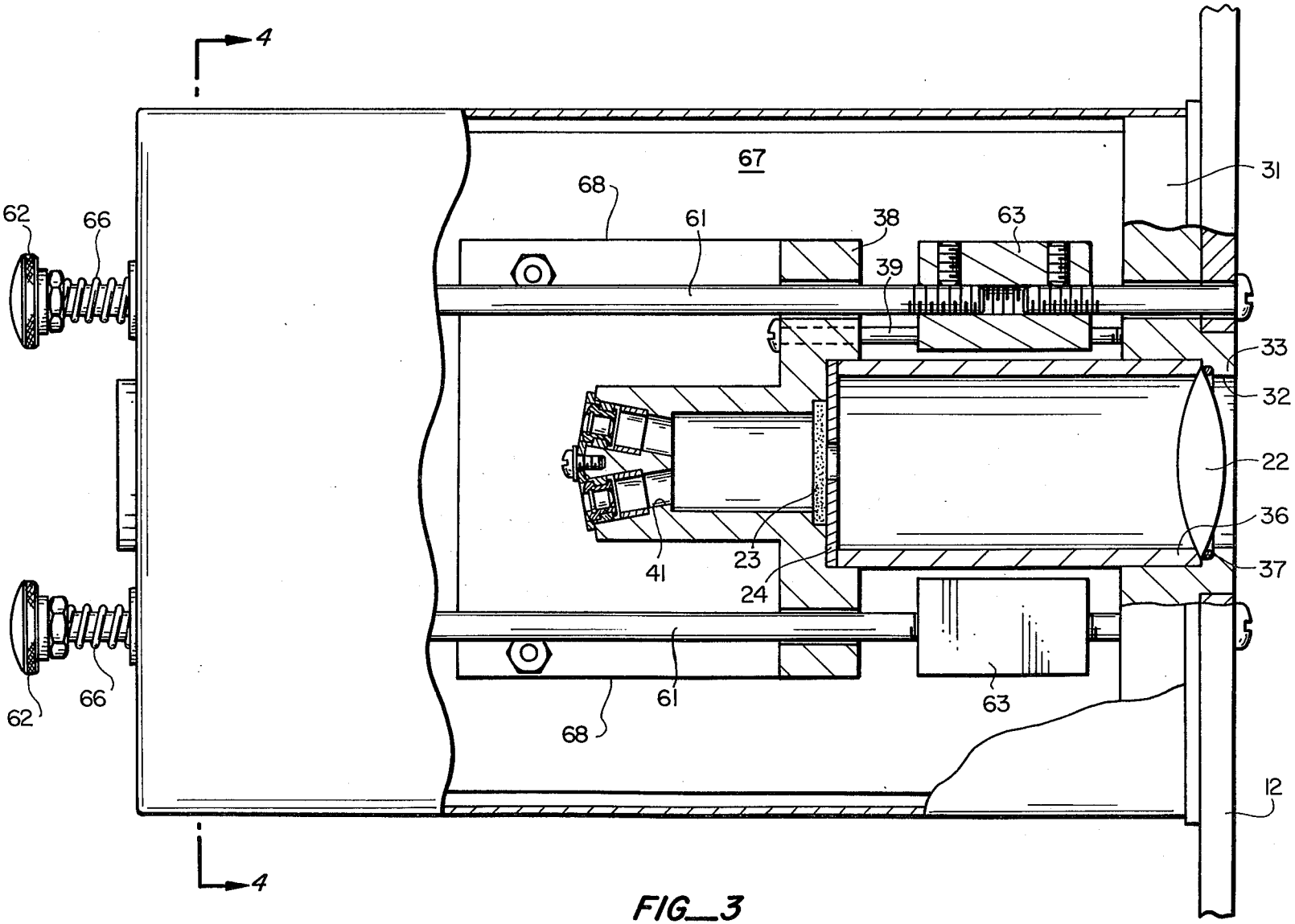
FIG. 3 is a view partly in section of the optical system assembly.

Before describing the operation of the sorting system of FIG. 1 in more detail, reference is made to FIGS. 3 through 5 which are a detailed drawing of an optical system suitable for use in the present invention. The assembly is adapted to be mounted upon the mounting means 12 adjacent to the rows of produce to sense the reflected light and to provide signals to the associated electrical circuits of FIG. 1. The optical system includes a mount 31 which supports optical system and electrical circuits on the mounting means 12 of the harvester equipment. The mount 31 includes an opening 32 having lip 33 which serves to retain lens 22. The opening is stepped to receive optical tube 36 which serves to hold the lens against the O-ring 37 and hold the lens in the mount 31 and form a seal.

The other end of the tube 36 receives lens holder 38, the lens holder 38 is held in contact with the end of the tube 36 by means of screws 39 which engage the mount 31. Field stop 24 is sandwiched between the lens holder 38 and the end of the tube 36. A ground glass diffuser 23 is sandwiched between the lens holder 38 and the field stop 24.

The end of the lens holder holds four photoelectric assemblies 26 disposed in four circumferentially located wells 41. A filter 42 is placed in the bottom of each well. Additionally phototransducer mount 43, a grounding plug 44, and an optical sensor or phototransducer 46 are mounted in each well. There are four such assemblies designated 51, 52, 53 and 54 in FIG. 4. The four assemblies are retained by means of a screw 56 and washer 57 which engages the adjacent edges of each of the assemblies.

The optical filters in the assemblies 51, 52, 53 and 54 are selected to pass different optical wavelengths. More particularly, the filters in the assemblies are selected to pass a band width of about 5 to 15 nm at the following wavelengths: filter in assembly 51 at 660 nm; filter in assembly 52 at 750 nm; filter in assembly 53 at 546 nm; and the filter in assembly 54 at 950 nm.

The optical assembly includes spring loaded shafts 61 having knobs 62 which extend into the housing and through the lens holder 38 to engage tie down nuts 63. The other ends of the nuts are adapted to be threaded to screws to secure the assembly to the mounting means 12. The springs 66 electrically ground the housing. Printed circuit board 67 is mounted on brackets 68 by means of standoffs 69 and screw 71. A cylindrical shield 72, FIG. 1, is secured to the mount 31.

FIG. 6 is a chart showing reflection as a function of wavelength for tomatoes of various ripeness and for foreign objects, namely dirt. The curve 81 shows the color characteristics of a bright red tomato. It is observed that the energy reflected rises from about 400 nm to about 660 nm where it reaches a plateau and then decreases at about 950 nm and again increases. The dip at the point 82 is due to absorption of the energy by the water in the tomato. Curve 83 shows the color characteristics for a pink tomato. It is observed that there is a slight dip in the region 84. Again, there is a dip in the region 82 because of water absorption. Curve 86 shows the reflection of a green tomato with a greater dip in the region 84. The tomatoes designated by the curves 83 and 86 are so-called pink and green breaker tomatoes whereby the electronic circuits associated with the phototransducers can be set to either reject or accept these tomatoes. The curve 87 shows the characteristics of green tomatoes. It is seen that there is a large absorption at the region 84 permitting easy detection and identification. The color sorting equipment observes the reflected energy at two wavelengths, namely 546 nm and 660 nm, and generates electrical signals responsive to the reflected energy. It is to be seen that acceptable tomatoes always have a lower reflected energy at 546 nm than at 660 nm, whereas in contrast, green tomatoes have a lower energy at 660 nm in comparison to 546 nm. Thus, a circuit which compares the energy at the two wavelengths can be set to generate a reject signal when the generated signals at the two wavelengths have a predetermined relationship.

Referring to the same figure, the curves 91, 92 and 93 represent the reflection of dirt taken at three different localities. Of significance is the fact that the reflectance rises towards the infra-red. Thus, if a reading is taken at 750 nm and another at 950 nm, the energy at 950 nm is greater than at 750 nm. The energy is also greater at 660 nm than at 546 nm. Thus, where the energy is greater at the longer wavelength, dirt is being observed and no reject signal is generated at 550 nm and 660 nm. However, a reject signal can be generated at 750 nm and 950 nm and yet discriminate tomatoes which have lower energy at the longer wavelength because of absorption by water.

Referring now again to FIG. 1, the signals from the phototransducers 52 and 54 associated with the 750 nm and 950 nm filters are shown applied to amplifiers 102 and 101. The amplifier 101 includes a gain control designated generally by the arrow 103 whereby the level of the signal output from the amplifier can be controlled. The outputs of the amplifiers 101 and 102 are applied to comparator 104 which generates a reject signal when the output from the amplifier 101 is greater than the output from the amplifier 102. This means that dirt or other foreign objects have been detected. The reject signal is applied to OR gate 106. The output from the OR gate is applied to a delay and drive circuit 107 which forms a delayed drive signal for driving valve 108. The valve applies air pressure to reject device 109 to drive bopper 111 which strikes the foreign object to reject the object. A reject assembly of the type shown is described in copending application entitled COLOR SORTING SYSTEM, Ser. No. 793,679 filed May 4, 1977, in the names of Robert G. Husome, Ron J. Fleming and Ron E. Swanson, assigned in-part to the same assignee.

There are provided second amplifiers 112 and 113 with amplifier 112 including a gain control 114. The outputs from the phototransducers associated with the 546 nm and 660 nm color filters are applied to amplifiers 112 and 113, respectively, and the gain of the amplifier 112 is adjusted to thereby select the type of tomatoes to be rejected. If the tomato is green the signal from the amplifier 112 will be greater than the signal from the amplifier 113 and the comparator 115 will generate a reject signal which is applied to the OR gate 106 to drive bopper 111 as previously described and reject the cull.

Thus there is provided a reject system which is simple in operation and which can be adjusted in the field to suit the particular field conditions to sort tomatoes of various ripeness. Further, the system rejects foreign objects such as dirt, debris, stems and the like.

Although the system has been described in connection with tomato sorting it can be used in the sorting of other produce which has different reflecting characteristics at different wavelengths and which absorb energy in the infra red because of the water content.

I claim:

1. A color sorter system for sorting produce and rejecting foreign objects comprising means for causing the produce and objects to be sorted and rejected to pass an inspection station, means at the inspection station for illuminating the produce and objects, means for receiving radiant energy reflected from the produce and objects and forming first and second produce sorting signals and first and second foreign object reject signals, said produce sorting signals being generated responsive to reflected energy at first and second wavelengths and said foreign object reject signals being generated responsive to energy at third and fourth wavelengths, means for comparing said first and second produce sorting signals and generating a produce reject signal when the signals have a predetermined relationship and means for comparing said third and fourth signals and generating a foreign object reject signal when said foreign reject signals have a predetermined relationship.

2. A system as in claim 1 in which said first and second wavelengths are selected to correspond to red and green and in which one of said third and fourth wavelengths is selected to correspond to the wavelength at which water absorbs radiant energy.

3. A system as in claim 1 including a reject assembly for rejecting the unwanted produce and foreign objects and wherein said produce reject signals and foreign object reject signals are applied to selectively activate said reject assembly.

4. A color sorting apparatus comprising means for moving the objects to be sorted along a predetermined path past an inspection station, means at the inspection station for illuminating the objects, a diffuser plate, means forming an image of the objects on the diffuser plate to generate diffuse light, a field stop defining a light aperture disposed between the image forming means and diffuser plates to limit the size of the image formed on the plate so that the image of objects of different sizes substantially covers the aperture, a plurality of phototransducers disposed to receive light diffused from said plate, first and second filter means positioned to pass a relatively narrow band of green and red light to respectively a first pair of transducers to form a first pair of color signals, third and fourth filter means disposed to pass a narrow band of light of different wavelengths to a second pair of transducers to form a second pair of signals, first and second comparator means for receiving said first and second pair of signals and forming reject signals when the signals from each pair of said transducers has a predetermined relationship, and means responsive to a reject signal for rejecting culls or foreign objects from the predetermined path.

5. A color sorter apparatus as in claim 4 wherein said first and second filter means are selected to pass light over a predetermined band of wavelengths in the region of 546 nm and 660 nm, respectively, and in which said third and fourth filters are selected to pass light in a predetermined band in the region of 750 nm and 950 nm respectively.

6. A tomato sorter including a foreign object reject system comprising means for causing the tomatoes and foreign objects, if any, to flow past an inspection station, means at the inspection station for illuminating the tomatoes and objects, means at said inspection station for measuring the reflectance of tomatoes and objects at wavelengths of about 750 nm and about 950 nm and at about 546 nm and about 660 nm and rejecting objects having a higher reflectance at 950 nm that at 750 nm and for rejecting tomatoes which have a lower reflectance at 660 nm than at 546 nm.

7. A system as in claim 6 wherein said means for rejecting tomatoes comprises first and second phototransducers adapted to generate signals corresponding to reflected energy at 546 nm and 660 nm and a comparator serving to receive the signals and form a reject signal when the tomato has a lower reflectance at 660 nm than at 546 nm; and third and fourth phototransducers adapted to generate signals corresponding to reflected energy at the 950 nm and 750 nm and a comparator serving to receive said signals and to form a reject signal when the object has the higher reflectance at 950 nm than 750 nm.

* * * * *